US009179735B2

(12) United States Patent
Choi et al.

(10) Patent No.: US 9,179,735 B2
(45) Date of Patent: Nov. 10, 2015

(54) CLIMBING SHOES OUTSOLE HAVING GOOD ADHESIVE AND NON-SLIP PROPERTIES AND METHOD FOR MANUFACTURING THEREOF

(71) Applicants: NANOTECHCERAMICS CO., LTD., Busan (KR); KOREA INSTITUTE OF FOOTWEAR & LEATHER TECHNOLOGY, Busan (KR)

(72) Inventors: Kyung Man Choi, Busan (KR); Young Min Kim, Busan (KR); Ji Eun Lee, Busan (KR); Dong Hun Han, Busanjin-gu (KR)

(73) Assignees: NANOTECHCERAMICS CO., LTD., Busan (KR); KOREA INSTITUTE OF FOOTWEAR & LEATHER TECHNOLOGY, Busan (KR)

( * ) Notice: Subject to any disclaimer, the term of this patent is extended or adjusted under 35 U.S.C. 154(b) by 402 days.

(21) Appl. No.: 13/649,954

(22) Filed: Oct. 11, 2012

(65) Prior Publication Data

US 2013/0086822 A1 Apr. 11, 2013

(30) Foreign Application Priority Data

Oct. 11, 2011 (KR) ..... 10-2011-0103563

(51) Int. Cl.

| | |
|---|---|
| *A43B 13/12* | (2006.01) |
| *A43B 13/04* | (2006.01) |
| *A43B 13/22* | (2006.01) |

(52) U.S. Cl.

CPC ..... *A43B 13/12* (2013.01); *A43B 13/04* (2013.01); *A43B 13/122* (2013.01); *A43B 13/22* (2013.01)

(58) Field of Classification Search

USPC ..... 36/30 R; 12/146 B

See application file for complete search history.

(56) References Cited

FOREIGN PATENT DOCUMENTS

| | | | | |
|---|---|---|---|---|
| KR | 10-2006009729 | * | 7/2004 | ..... C08L 9/00 |
| KR | 10-20060042463 | * | 11/2004 | ..... C08L 53/02 |
| KR | 10-2006-0009729 A | | 2/2006 | |
| KR | 10-0614887 B1 | | 8/2006 | |

* cited by examiner

*Primary Examiner* — Robert Harlan

(74) *Attorney, Agent, or Firm* — Birch, Stewart, Kolasch & Birch, LLP

(57) ABSTRACT

Disclosed are a climbing shoes outsole with good adhesive and non-slip properties and a method for manufacturing the same. More specifically, the climbing shoes outsole comprises a butyl rubber layer formed at a side of the outsole in contact with the ground, and a general-purpose rubber layer laminated on the butyl rubber layer.

3 Claims, 1 Drawing Sheet

CLIMBING SHOES OUTSOLE HAVING GOOD ADHESIVE AND NON-SLIP PROPERTIES AND METHOD FOR MANUFACTURING THEREOF

BACKGROUND OF THE INVENTION

1. Field of the Invention

The present invention relates to a climbing shoes outsole with good adhesive and non-slip properties and a method for manufacturing the same. More specifically, the present invention relates to a climbing shoes outsole with good adhesive and non-slip properties that has a laminate structure including a butyl rubber as a lower layer of the outsole (side in contact with the ground), and a general-purpose rubber as an upper layer of the outsole (side of the outsole adhered to a midsole or upper), and a method for manufacturing the same.

2. Description of the Related Art

In general, a butyl rubber is widely used for tire inner liners, dustproof materials, automobile tubes and the like due to low gas permeation. Also, a butyl rubber is used as a material for climbing shoes outsoles owing to considerably superior non-slip properties.

Furthermore, as described above, the butyl rubber used as a material for climbing shoes outsoles secures safety against slip and improves grip strength between shoes and the ground during climbing, thereby enhancing wear sensation and comfort. In this regard, materials for climbing shoes outsoles using a butyl rubber with superior non-slip property attract much attention to consumers.

However, companies that manufacture climbing shoes outsoles using a butyl rubber as a base material have a problem of high product defects due to low adhesive properties of butyl rubbers to midsoles or uppers.

In order to solve this problem, in an attempt to improve an adhesive strength through preliminary treatment, the adhesion surface of outsoles is subjected to buffing. However, such a buffing process causes various problems such as production of industrial wastes, noise and product defects caused by buffing.

Also, an expensive CR solvent-type adhesive agent is generally used as an adhesive agent of butyl rubbers. For this reason, problems such as increase in adhesion cost and bad workplace environments resulting from use of excess organic solvent occur.

Accordingly, in an attempt to solve the non-adhesive property, a resin or general-purpose rubber is used in conjunction with a butyl rubber.

However, in general, a butyl rubber has a low compatibility with a resin or a general-purpose rubber, thus having considerably low non-slip property, when used in combination therewith. In particular, when a butyl rubber is adhered to a general-purpose rubber by cross-linking, interfacial de-adhesion generally occurs due to great difference in cross-linking speed between the rubbers and decreased compatibility.

That is, in sulfur crosslinking, a butyl rubber has a considerably low cross-linking speed due to narrow cross-linkage sites. On the other hand, a general-purpose rubber has superior cross-linking activity in a sulfur cross-linking system, thus having a high cross-linking speed, as compared to a butyl rubber. For this reason, there is a difficulty in cross-linking adhesion due to great difference in cross-linking speed between the butyl rubber and the general-purpose rubber upon cross-linking adhesion.

There are conventional methods for adhering resins or rubbers for improving performance of compositions containing a butyl rubber as a base material. For example, a method for adhering a butyl rubber to a resin layer in the process of producing an inner liner for tires by adhering the butyl rubber to the resin layer and irradiating an electric beam thereto, to co-crosslink the butyl rubber and the resin layer is developed. However, in accordance with the method, selection of materials is limited in order to maintain adhesion strength, since adhesion strength between the butyl rubber and the resin layer depends on materials for the resin layer and butyl rubber members.

Meanwhile, as the related art, a method for adhering a resin layer to an adjacent rubber member using an indirect adhesive agent or a highly polar epoxy rubber is used. This indirect adhesive agent or highly polar rubber is expensive and entails use of compounding components having a high glass transition temperature, thus causing cracks or low low-temperature resistance in winter and being unsuitable for shoes to which roughness is repeatedly applied.

Furthermore, Japanese Patent Publication No. 2007-276235 discloses cross-linkage performed by adhering a thermoplastic elastomer resin laminate to a rubber composition member, irradiating an electric beam to the resin-rubber laminate-provided member and performing vulcanization. However, in accordance with this method, disadvantageously, a non-uniform net structure may be formed, heat resistance of rubber layer is decreased, and an interfacial de-adhesion thus occurs when an adhesive layer is not used, since carbon-carbon bonds and sulfur cross-linking are introduced into the rubber layer through electric beam irradiation and vulcanization.

RELATED ART

Patent Document

Patent Document 1: Japanese Patent Publication No. 2007-276235 entitled "Method for producing tires".

SUMMARY OF THE INVENTION

Therefore, the present invention has been made in view of the above problems, and it is one object of the present invention to provide a climbing shoes outsole with good adhesive and non-slip properties that has a laminate structure including a butyl rubber as a lower layer of the outsole (side in contact with the ground), and a general-purpose rubber as an upper layer of the outsole (side of the outsole adhered to a midsole or upper), unlike a conventional outsole using only a butyl rubber, to maintain the non-slip property of butyl rubber to the ground and improve adhesive strength to an adhesion surface of the midsole or upper, and a method for manufacturing the same.

Further, it is another object of the present invention to provide a climbing shoes outsole with good adhesive and non-slip properties that exhibits superior adhesive strength based on improvement of adhesive strength to the midsole or upper, although an aqueous adhesive agent is used instead of an expensive solvent-type adhesive agent conventionally used as an adhesive agent for butyl rubbers, eliminates the necessity of a buffing process which is a conventional separate preliminary treatment process for improving an adhesive strength and thereby solves problems including production of wastes and noise and product defects caused by buffing, and a method for manufacturing the same.

Further, it is another object of the present invention to provide a climbing shoes outsole with good adhesive and non-slip properties wherein a general-purpose rubber is laminated on a butyl rubber through cross-linking adhesion at a high temperature and a high pressure, which is a common shoes outsole molding method, unlike a conventional case using an electric beam cross-linking or an adhesive agent, to eliminate the necessity of separate manufacturing process, and a method for manufacturing the same.

In accordance with one aspect of the present invention, provided is a climbing shoes outsole with good adhesive and non-slip properties including: a butyl rubber layer formed at a side of the outsole in contact with the ground; and a general-purpose rubber layer laminated on the butyl rubber layer.

The butyl rubber layer may include: 2 to 5 parts by weight of metal oxide: 0.5 to 1.5 parts by weight of stearic acid; 30 to 60 parts by weight of silica; 0.5 to 4 parts by weight of a silane coupling agent; 0.5 to 4 parts by weight of polyethylene glycol; 1.5 to 2.5 parts by weight of a vulcanizer; and 1 to 4 parts by weight of a vulcanizing accelerator, with respect to 100 parts by weight of a butyl rubber.

The general-purpose rubber layer may include: 2 to 5 parts by weight of metal oxide; 0.5 to 1.5 parts by weight of stearic acid; 30 to 60 parts by weight of silica; 0.5 to 4 parts by weight of a silane coupling agent; 0.5 to 1.5 parts by weight of polyethylene glycol; 0.01 to 1.0 part by weight of a vulcanizer; and 0.5 to 2 parts by weight of a vulcanizing accelerator, with respect to 100 parts by weight of a base material including 25 to 40% by weight of a natural rubber, 20 to 50% by weight of a butadiene rubber and 25 to 40% by weight of a styrene-butadiene rubber.

In accordance with another aspect of the present invention, provided is a method for manufacturing an outsole for climbing shoes including: mixing 2 to 5 parts by weight of metal oxide, 0.5 to 1.5 parts by weight of stearic acid, 30 to 60 parts by weight of silica, 0.5 to 4 parts by weight of a silane coupling agent, 0.5 to 4 parts by weight of polyethylene glycol, with respect to 100 parts by weight of a butyl rubber, at a temperature of 90 to 100° C. in a kneader for 10 to 15 minutes, and adding 1.5 to 2.5 parts by weight of a vulcanizer and 1 to 4 parts by weight of a vulcanizing accelerator to the resulting mixture in a roll mill to form a butyl rubber layer having a sheet shape (S1); mixing 2 to 5 parts by weight of metal oxide, 0.5 to 1.5 parts by weight of stearic acid, 30 to 60 parts by weight of silica, 0.5 to 4 parts by weight of a silane coupling agent, and 0.5 to 1.5 parts by weight of polyethylene glycol, with respect to 100 parts by weight of a base material including 25 to 40% by weight of a natural rubber, 20 to 50% by weight of a butadiene rubber and 25 to 40% by weight of a styrene-butadiene rubber, at a temperature of 90 to 100° C. in a kneader for 10 to 15 minutes, and adding 0.01 to 1.0 part by weight of a vulcanizer and 0.5 to 2 parts by weight of a vulcanizing accelerator to the resulting mixture in a roll mill to form a general-purpose rubber layer having a sheet shape (S2); and molding the butyl rubber layer and general-purpose rubber layer in a press at a temperature of 155 to 170° C. and a pressure of 110 to 120 kg/cm$^2$ for 12 to 17 minutes, followed by cross-linking adhesion (S3).

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION OF THE INVENTION

The present invention is directed to a climbing shoes outsole having superior adhesivity and non-slip property to accomplish the aspects. It should be noted that only components required for understanding of the technical configurations of the present invention are described and description of other components is omitted so that the subject matters of the present invention are not obscure.

Hereinafter, the climbing shoes outsole with good adhesive and non-slip properties according to the present invention will be described in detail.

Figure 1:
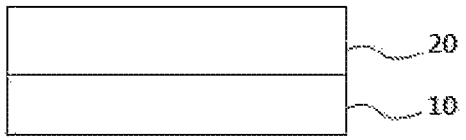
FIG. 1 is a sectional view illustrating a configuration of a climbing shoes outsole with good adhesive and non-slip properties according to an embodiment of the present invention.

As shown in FIG. 1, the climbing shoes outsole with good adhesive and non-slip properties according to the present invention includes a butyl rubber layer 10 formed at a side of the outsole in contact with the ground, and a general-purpose rubber layer 20 laminated on the butyl rubber layer 10.

The butyl rubber layer comprises 2 to 5 parts by weight of metal oxide, 0.5 to 1.5 parts by weight of stearic acid, 30 to 60 parts by weight of silica, 0.5 to 4 parts by weight of a silane coupling agent, 0.5 to 4 parts by weight of polyethylene glycol, 1.5 to 2.5 parts by weight of a vulcanizer, and 1 to 4 parts by weight of a vulcanizing accelerator, with respect to 100 parts by weight of a butyl rubber.

Furthermore, the general-purpose rubber layer comprises 2 to 5 parts by weight of metal oxide, 0.5 to 1.5 parts by weight of stearic acid, 30 to 60 parts by weight of silica, 0.5 to 4 parts by weight of a silane coupling agent, 0.5 to 1.5 parts by weight of polyethylene glycol, 0.01 to 1.0 part by weight of a vulcanizer, and 0.5 to 2 parts by weight of a vulcanizing accelerator, with respect to 100 parts by weight of a base material comprising 25 to 40% by weight of a natural rubber, 20 to 50% by weight of a butadiene rubber and 25 to 40% by weight of a styrene-butadiene rubber.

Meanwhile, the butyl rubber used for the present invention may be a butyl rubber (IIR), a bromobutyl rubber (BIIR) or a chlorinated butyl rubber (CIIR), or a combination thereof.

Furthermore, as described above, the general-purpose rubber layer uses 25 to 40% by weight of the natural rubber, 20 to 50% by weight of the butadiene rubber, and 25 to 40% by weight of the styrene-butadiene rubber. The natural rubber is a rubber that has excellent affinity to silica described below and enhances reinforcement property of silica. When the amount of natural rubber is lower than 25% by weight, affinity to silica is decreased and reinforcement property of silica may be thus deteriorated, and when the amount of natural rubber exceeds 40% by weight, moldability may be deteriorated. The butadiene rubber is a rubber that can enhance superior mechanical strength and corrosion resistance. When the amount of the butadiene rubber is lower than 20% by weight, open roll mill workability may be improved, but physical properties such as mechanical strength and corrosion resistance may be thus deteriorated, and when the amount of the butadiene rubber exceeds 50% by weight, flowability of butadiene rubber is low and open roll mill workability may be thus deteriorated. Also, the styrene-butadiene rubber is a rubber that maintains hardness and mechanical strength of a rubber compound, controls stickiness of the compound and thereby enhances stability. When the amount of the styrene rubber is lower than 25% by weight, physical properties such as hardness and mechanical strength of the rubber composition may be deteriorated, and when the amount of the styrene rubber exceeds 40% by weight, hardness of the rubber composition is improved and moldability may be thus deteriorated.

The silica used for the present invention aims at improving mechanical strength. For formation of the butyl rubber layer or general-purpose rubber layer, the silica is used at an amount of 30 to 60 parts by weight. When the amount of the silica is lower than 30 parts by weight, hardness required for climbing shoes outsoles cannot be satisfied and when the amount of the silica exceeds 60 parts by weight, dispersibility is decreased and mechanical strength or workability may be disadvantageously deteriorated.

Meanwhile, preferably, a difference between the amount of silica used for formation of the butyl rubber layer and the amount of silica used for formation of the general-purpose rubber layer may be within 5 parts by weight. When the silica is used at an amount exceeding the range defined above, compatibility is deteriorated due to difference in viscosity of composition and the silica may be thus disadvantageously detached from the interface due to decreased adhesive property upon adhesion and molding.

The vulcanizer used for the present invention aims at cross-linking respective compositions and is used at an amount of 1.5 to 2.5 parts by weight for formation of the butyl rubber layer, and is used at an amount of 0.01 to 1.0 part by weight for formation of the general-purpose rubber layer.

When the amount of the vulcanizer used for formation of the butyl rubber layer is lower than 1.5 parts by weight, a cross-linking speed is considerably low, cross-linking degree is decreased and mechanical strength may be thus deteriorated, and when the amount of the vulcanizer exceeds 2.5 parts by weight, a blooming phenomenon may occur due to use of excess sulfur.

Further, when the amount of the vulcanizer used for formation of the general-purpose rubber layer is lower than 0.01 parts by weight, adhesion strength is disadvantageously decreased due to decrease in cross-linking level. When the amount of the vulcanizer exceeds 1.0 part by weight, the rubber layer may be separated from the interface (interfacial de-adhesion) due to high cross-linking speed.

The vulcanizing accelerator used for the present invention aims at facilitating functions of the vulcanizer and is used at an amount of 1 to 4 parts by weight for formation of the butyl rubber layer, and is used at an amount of 0.5 to 2.0 parts by weight for formation of the general-purpose rubber layer.

When the amount of the vulcanizing accelerator used for formation of the butyl rubber layer is lower than 1 part by weight, difference in cross-linking speed between the butyl rubber layer and the general-purpose rubber layer increases due to low cross-linking speed and a problem associated with cross-linking adhesion may occur, and when the amount of the vulcanizing accelerator exceeds 4 parts by weight, similar to the vulcanizer, blooming or scotch may occur.

Furthermore, when the amount of the vulcanizing accelerator used for formation of the general-purpose rubber layer is lower than 0.5 parts by weight, adhesion strength is deteriorated due to decrease in cross-linking level and cross-linking speed, and when the amount of the vulcanizing accelerator exceeds 2 parts by weight, interfacial de-adhesion may occur due to difference in the cross-linking speed.

Meanwhile, as described above, 1.5 to 2.5 parts by weight of the vulcanizer and 1 to 4 parts by weight of the vulcanizing accelerator are used for formation of the butyl rubber layer, and 0.01 to 1.0 part by weight of the vulcanizer and 0.5 to 2 parts by weight of the vulcanizing accelerator are used for formation of the general-purpose rubber layer. The reason is that, according to the present invention, a cross-linking system at which two compositions have similar cross-linking speeds should be designed so as to realize superior adhesive strength on the interface and prevent a problem of de-adhesion (detachment), since products are formed through laminate-vulcanization of the butyl rubber layer and the general-purpose rubber layer. That is, since a butyl rubber generally has a considerably low cross-linking speed in a sulfur cross-linking system, as compared to a general rubber, design of a cross-linking system in which the general-purpose rubber layer and the butyl rubber layer have similar cross-linking speeds is required.

Meanwhile, in the present invention, sulfur or insoluble sulfur may be used as a cross-linking agent. A crosslinking accelerator may be selected from the group consisting of thiazole such as mercaptobenzothiazole (MBT), and dibenzothiazole disulfide (MBTS), and zinc salts of 2-mercaptobenzothiazole (ZnMBT), thiuram such as tetramethylthiuram monosulfide (TMTM), tetramethylthiuram disulfide (TMTD), tetraethylthiuram sulfide (TETD), tetrabutylthiuram sulfide (TBTD), dipentamethylene thiuram tetra sulfide (DPTT) and a combination thereof.

The silane coupling agent used for the present invention is added so as to improve dispersion and reinforcement of the composition. The silane coupling agent may be selected from the group consisting of vinylsilane such as vinyltriethoxysilane, vinyltri(2-methoxyethoxy)silane, and 3-methacryloxypropyltrimethoxysilane, N-phenyl-3-aminopropyltrimethoxysilane, 3-mercaptopropyl trimethoxysilane, bis(triethoxysilylpropyl)tetrasulfane, thiocyanatopropyltriethoxysilane and a combination thereof. Of these, bis(triethoxysilylpropyl)tetrasulfane and thiocyanatopropyltriethoxysilane suitable for vulcanization cross-linking are preferred.

Meanwhile, the silane coupling agent is used at an amount of 0.5 to 4 parts by weight for production of the butyl rubber layer or the general-purpose rubber layer. When the amount of the silane coupling agent is lower than 0.5 parts by weight, dispersibility may be deteriorated, and when the amount of the silane coupling agent exceeds 4 parts by weight, side reactions occur due to excess silane coupling agent and mechanical strength and non-slip property are disadvantageously decreased.

Meanwhile, as additives commonly used for shoes outsoles of the present invention, 2 to 5 parts by weight of metal oxide, 0.5 to 1.5 parts by weight of stearic acid, and 0.5 to 4 parts by weight of polyethylene glycol may be used. The content ranges of additives are commonly used for rubber composition for shoes outsoles.

Hereinafter, a method for manufacturing the climbing shoes outsole with good adhesive and non-slip properties according to the present invention will be described in detail.

Figure 2:
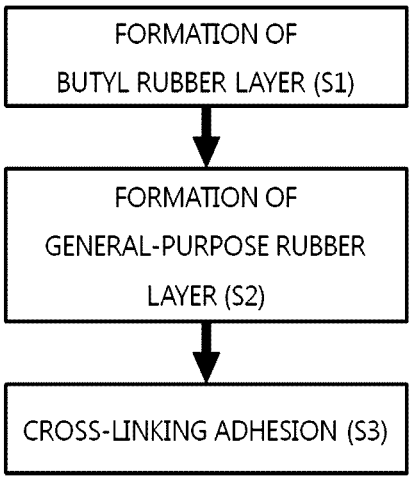
FIG. 2 is a flowchart illustrating a method for manufacturing a climbing shoes outsole with good adhesive and non-slip properties according to one embodiment of an present invention.

As shown in FIG. 2, a method for manufacturing the climbing shoes outsole with good adhesive and non-slip properties according to the present invention includes formation of a butyl rubber layer (S1), formation of a general-purpose rubber layer (S2) and cross-linking adhesion (S3).

More specifically, in the formation of the butyl rubber layer (S1), 2 to 5 parts by weight of metal oxide, 0.5 to 1.5 parts by weight of stearic acid, 30 to 60 parts by weight of silica, 0.5 to 4 parts by weight of a silane coupling agent, and 0.5 to 4 parts by weight of polyethylene glycol, with respect to 100 parts by weight of a butyl rubber, are mixed at a temperature of 90 to 100° C. in a kneader for 10 to 15 minutes, and 1.5 to 2.5 parts by weight of a vulcanizer and 1 to 4 parts by weight of a vulcanizing accelerator are then added to the resulting mixture in a roll mill, to form a butyl rubber layer having a sheet shape. In the formation of the general-purpose rubber layer (S2), 2 to 5 parts by weight of metal oxide, 0.5 to 1.5 parts by weight of stearic acid, 30 to 60 parts by weight of silica, 0.5 to 4 parts by weight of a silane coupling agent, and 0.5 to 1.5 parts by weight of polyethylene glycol, with respect to 100 parts by weight of a base material comprising 25 to 40% by weight of a natural rubber, 20 to 50% by weight of a butadiene rubber and 25 to 40% by weight of a styrene-butadiene rubber, were mixed at a temperature of 90 to 100° C. in a kneader for 10 to 15 minutes, and 0.01 to 1.0 part by weight of a vulcanizer and 0.5 to 2 parts by weight of a vulcanizing accelerator are then added to the resulting mixture in a roll mill to form a general-purpose rubber layer having a sheet shape. Then, in the cross-linking adhesion (S3), the formed butyl rubber layer and the general-purpose rubber layer are molded using a press at a temperature of 155 to 170° C. and at a pressure of 110 to 120 kg/cm$^2$ for 12 to 17 minutes, followed by cross-linking adhesion.

Here, when conditions such as temperature and pressure applied to the respective formation processes are not within the range defined above, physical properties of butyl rubber layer or general-purpose rubber layer are deteriorated, or defects such as separation between the butyl rubber layer and the general-purpose rubber layer may occur after molding.

Hereinafter, the present invention will be described in more detail with reference to the following examples. These examples are provided only to illustrate the present invention and should not be construed as limiting the scope and spirit of the present invention.

1. Manufacturing of Outsole for Climbing Shoes

Example 1

3 parts by weight of zinc oxide, 1 part by weight of stearic acid, 3 parts by weight of polyethylene glycol, 3 parts by weight of a silane coupling agent, and 50 parts by weight of silica, with respect to 100 parts by weight of a butyl rubber, were mixed at a temperature of 100° C. in a kneader for about 12 minutes, and 1.8 parts by weight of a vulcanizer and 2.2 parts by weight of a vulcanizing accelerator were then added to the resulting mixture in an open roll mill, followed by homogeneously mixing to produce a butyl rubber layer having a 3 to 4 mm sheet shape. 3 parts by weight of zinc oxide, 1 part by weight of stearic acid, 1 part by weight of polyethylene glycol, 3 parts by weight of a silane coupling agent, and 50 parts by weight of silica, with respect to 100 parts by weight of a base material comprising 30 parts by weight of a natural rubber, parts by weight of a styrene-butadiene rubber and 40 parts by weight of a butadiene rubber, were mixed at 100° C. in a kneader for about 12 minutes, and 0.7 parts by weight of a vulcanizer and 1.0 part by weight of a vulcanizing accelerator were then added to the resulting mixture in an open roll mill, followed by homogeneously mixing, to produce a general-purpose rubber layer having a 1 to 2 mm sheet shape. Then, the butyl rubber layer and the general-purpose rubber layer were laminated on a die with a thickness of 5 mm, followed by press-molding under pressing conditions of 160° C. and 120 kg/cm$^2$ for about 15 minutes to manufacture an outsole for climbing shoes.

Example 2

3 parts by weight of zinc oxide, 1 part by weight of stearic acid, 3 parts by weight of polyethylene glycol, 2 parts by weight of a silane coupling agent, and 40 parts by weight of silica, with respect to 100 parts by weight of a bromobutyl rubber, were mixed at a temperature of 100° C. in a kneader for about 12 minutes, and 1.8 parts by weight of a vulcanizer and 2.2 parts by weight of a vulcanizing accelerator were then added to the resulting mixture in an open roll mill, followed by homogeneously mixing to produce a butyl rubber layer having a 3 to 4 mm sheet shape. 3 parts by weight of zinc oxide, 1 part by weight of stearic acid, 0.5 parts by weight of polyethylene glycol, 2 parts by weight of a silane coupling agent, and 40 parts by weight of silica, with respect to 100 parts by weight of a base material comprising 30 parts by weight of a natural rubber, parts by weight of a styrene-butadiene rubber and 40 parts by weight of a butadiene rubber, were mixed at 100° C. in a kneader for about 12 minutes, and 0.5 parts by weight of a vulcanizer and 1.0 part by weight of a vulcanizing accelerator were then added to the resulting mixture in an open roll mill, followed by homogeneously mixing to produce a general-purpose rubber layer having a 1 to 2 mm sheet shape. Then, the butyl rubber layer and the general-purpose rubber layer were laminated on a die with a thickness of 5 mm, followed by press-molding under pressing conditions of 160° C. and 120 kg/cm$^2$ for about 15 minutes to manufacture an outsole for climbing shoes.

Comparative Example 1

3 parts by weight of zinc oxide, 1 part by weight of stearic acid, 3 parts by weight of polyethylene glycol, 3 parts by weight of a silane coupling agent, and 50 parts by weight of silica, with respect to 100 parts by weight of a butyl rubber were mixed at a temperature of 100° C. in a kneader for about 12 minutes, and 1.8 parts by weight of a vulcanizer and 2.2 parts by weight of a vulcanizing accelerator were then added to the resulting mixture in an open roll mill, followed by homogeneously mixing to produce a butyl rubber layer having a 3 to 4 mm sheet shape. 3 parts by weight of zinc oxide, 1 part by weight of stearic acid, 2 parts by weight of polyethylene glycol, 3 parts by weight of a silane coupling agent and 20 parts by weight of silica, with respect to 100 parts by weight of a base material comprising 30 parts by weight of a natural rubber, 30 parts by weight of a styrene-butadiene rubber, and 40 parts by weight of a butadiene rubber, were mixed at 100° C. in a kneader for about 12 minutes, and 2.0 parts by weight of a vulcanizer and 2.2 part by weight of a vulcanizing accelerator were then added to the resulting mixture in an open roll mill, followed by homogeneously mixing to produce a general-purpose rubber layer having a 1 to 2 mm sheet shape. Then, the butyl rubber layer and the general-purpose rubber layer were laminated on a die with a thickness of 5 mm, and was press-molded under pressing conditions of 160° C. and 120 kg/cm$^2$ for about 15 minutes to manufacture an outsole for climbing shoes.

Comparative Example 2

3 parts by weight of zinc oxide, 1 part by weight of stearic acid, 3 parts by weight of polyethylene glycol, 3 parts by weight of a silane coupling agent, and 40 parts by weight of silica, with respect to 100 parts by weight of a bromobutyl rubber, were mixed at a temperature of 100° C. in a kneader for about 12 minutes, and 1.8 parts by weight of a vulcanizer and 2.2 parts by weight of a vulcanizing accelerator were then added to the resulting mixture in an open roll mill, followed by homogeneously mixing to produce a butyl rubber layer having a 3 to 4 mm sheet shape. 3 parts by weight of zinc oxide, 1 part by weight of stearic acid, 2 parts by weight of polyethylene glycol, 2 parts by weight of a silane coupling agent and 25 parts by weight of silica, with respect to 100 parts by weight of a base material comprising 30 parts by weight of a natural rubber, 30 parts by weight of a styrene-butadiene rubber and 40 parts by weight of a butadiene rubber, were mixed at 100° C. in a kneader for about 12 minutes, and 1.8 parts by weight of a vulcanizer and 2.5 parts by weight of a vulcanizing accelerator were then added to the resulting mixture in an open roll mill, followed by homogeneously mixing to produce a general-purpose rubber layer having a 1 to 2 mm sheet shape. Then, the butyl rubber layer and the general-purpose rubber layer were laminated on a die with a thickness of 5 mm, followed by press-molding under pressing conditions of 160° C. and 120 kg/cm$^2$ for about 15 minutes to manufacture an outsole for climbing shoes.

TABLE 1

| | | Ex. | | | | Comp. Ex. | | | |
|---|---|---|---|---|---|---|---|---|---|
| | | 1 | | 2 | | 1 | | 2 | |
| | Item | Butyl rubber layer | General-purpose rubber layer | Butyl rubber layer | General-purpose rubber layer | Butyl rubber layer | General-purpose rubber layer | Butyl rubber layer | General-purpose rubber layer |
| Base material (% by weight) | Butyl rubber[1)] | 100 | — | — | — | 100 | — | — | — |
| | Bromo butyl rubber[2)] | — | — | 100 | — | — | — | 100 | — |
| | Natural rubber[3)] | — | 30 | — | 30 | — | 30 | — | 30 |
| | Butadiene rubber[4)] | — | 40 | — | 40 | — | 40 | — | 40 |
| | Styrene-butadiene rubber[5)] | — | 30 | — | 30 | — | 30 | — | 30 |
| Additive (parts by weight) | Zinc oxide[6)] | 3 | 3 | 3 | 3 | 3 | 3 | 3 | 3 |
| | Stearic acid[7)] | 1 | 1 | 1 | 1 | 1 | 1 | 1 | 1 |
| | Silane coupling agent[8)] | 3 | 3 | 2 | 2 | 3 | 3 | 2 | 2 |
| | Silica[9)] | 50 | 50 | 40 | 40 | 50 | 20 | 40 | 25 |
| | Polyethylene glycol[10)] | 3 | 1 | 3 | 0.5 | 3 | 2 | 3 | 2 |
| | Vulcanizer[11)] | 1.8 | 0.7 | 1.8 | 0.5 | 1.8 | 2.0 | 1.8 | 1.8 |
| | Vulcanizing accelerator[12)] | 2.2 | 1.0 | 2.2 | 1.0 | 2.2 | 2.2 | 2.2 | 2.5 |
| | Total | 164 | 159.7 | 153 | 148 | 164 | 133.2 | 153 | 137.3 |
| Cross-linking speed | T10, min | 2 | 2.2 | 2.4 | 2.2 | 2 | 0.8 | 2.4 | 0.6 |
| | T9, min | 15 | 14.8 | 14 | 14.3 | 15 | 6.6 | 14 | 7.2 |

[1)]ExxonMobil, IIR 268
[2)]ExxonMobil, BIIR 2244
[3)]made in Vietnam, SVR 3L
[4)]Korea Kumho. Petrochemical Co., Ltd., KBR01
[5)]Korea Kumho. Petrochemical Co., Ltd., SBR1502
[6)]PJ CHEMTEK Co., LTD, Zinc oxide (rubber-type I)
[7)]LG Chem. Ltd., stearic acid
[8)]Degussa, Si-69
[9)]Rhodia, Zeosil 155
[10)]KPX Green Chemical Co., Ltd., PEG4000
[11)]Miwon Chemicals Co., Ltd., sulfur
[12)]Samwonchem Co., Ltd., M, DM, TS

2. Evaluation of Physical Properties

The cross-linking adhesion between the butyl rubber layer and the general-purpose rubber layer in Examples 1 and 2 and Comparative Examples 1 and 2 was evaluated in the following test method. The results are shown in Table 2.

1) Adhesion strength: measured in accordance with KSM 6518.

TABLE 2

| | | Ex. | | Comp. Ex. | |
|---|---|---|---|---|---|
| Test item | Unit | 1 | 2 | 1 | 2 |
| Adhesive strength | Kg/cm | 7.5 | 6.5 | 2.5 | 2.3 |
| Adhesion state | Appearance | Adherent is broken | Adherent is broken | Surface peel | Surface peel |

As shown in Table 2, the composition including double layers of the butyl rubber layer and the general-purpose rubber layer shown in Examples 1 and 2 exhibited superior adhesion strength and caused breakage of an adherent. On the other hand, Comparative Examples 1 and 2 had low adhesion strength and did not cause breakage of adherent. It could be seen that, in the rubber-blended composition according to the present invention, adhesive strength between the butyl rubber layer and the general-purpose rubber layer was greatly varied, depending on the content of reinforcement filler and vulcanization system. As apparent from the fore-going, unlike a conventional outsole using only a butyl rubber, the climbing shoes outsole according to the present invention has a laminate structure including a butyl rubber as a lower layer of the outsole (side of the outsole in contact with the ground), and a general-purpose rubber as an upper layer of the outsole (side of the outsole adhered to a midsole or upper), thus advantageously maintaining the non-slip property of butyl rubber to the ground and improving adhesive strength to an adhesion surface of the midsole or upper. Further, advantageously, the climbing shoes outsole according to the present invention exhibits superior adhesive strength based on improvement of adhesive strength to the midsole or upper, although an aqueous adhesive agent is used instead of an expensive solvent-type adhesive agent conventionally used as an adhesive agent for butyl rubbers, and eliminates the necessity of a buffing process which is a conventional separate preliminary treatment process for improving an adhesive strength, thereby solving problems including production of wastes and noise and product defects caused by the buffing.

Further, a general-purpose rubber is laminated on a butyl rubber through cross-linking adhesion at a high temperature and a high pressure, which is a common shoes outsole molding method, unlike a conventional case using an electric beam cross-linking or an adhesive agent, thereby eliminating the necessity of separate manufacturing process.

Although the preferred embodiments of the climbing shoes outsole with good adhesive and non-slip properties and the method for manufacturing the same according to the present invention have been disclosed for illustrative purposes, those skilled in the art will appreciate that various modifications, additions and substitutions are possible, without departing from the scope and spirit of the invention as disclosed in the accompanying claims.

What is claimed is:

1. A climbing shoes outsole with good adhesive and non-slip properties comprising:

a butyl rubber layer formed at a side of the outsole in contact with the ground; and a rubber layer laminated on the butyl rubber layer, wherein the rubber layer laminated on the butyl rubber layer comprises:

2 to 5 parts by weight of metal oxide;

0.5 to 1.5 parts by weight of stearic acid;

30 to 60 parts by weight of silica;

0.5 to 4 parts by weight of a silane coupling agent;

0.5 to 1.5 parts by weight of polyethylene glycol;

0.01 to 1.0 part by weight of a vulcanizer; and 0.5 to 2 parts by weight of a vulcanizing accelerator, with respect to 100 parts by weight of a base material comprising 25 to 40% by weight of a natural rubber, 20 to 50% by weight of a butadiene rubber and 25 to 40% by weight of a styrene-butadiene rubber.

2. The climbing shoes outsole according to claim 1, wherein the butyl rubber layer comprises:

2 to 5 parts by weight of metal oxide:

0.5 to 1.5 parts by weight of stearic acid;

30 to 60 parts by weight of silica;

0.5 to 4 parts by weight of a silane coupling agent;

0.5 to 4 parts by weight of polyethylene glycol;

1.5 to 2.5 parts by weight of a vulcanizer; and 1 to 4 parts by weight of a vulcanizing accelerator, with respect to 100 parts by weight of a butyl rubber.

3. A climbing shoes outsole with good adhesive and non-slip properties comprising:

a butyl rubber layer formed at a side of the outsole in contact with the ground; and a rubber layer laminated on the butyl rubber layer, wherein the butyl rubber layer comprises:

2 to 5 parts by weight of metal oxide:

0.5 to 1.5 parts by weight of stearic acid;

30 to 60 parts by weight of silica;

0.5 to 4 parts by weight of a silane coupling agent;

0.5 to 4 parts by weight of polyethylene glycol;

1.5 to 2.5 parts by weight of a vulcanizer; and 1 to 4 parts by weight of a vulcanizing accelerator, with respect to 100 parts by weight of a butyl rubber.

* * * * *